US006145572A

United States Patent [19]

Kraeutler

[11] Patent Number: 6,145,572

[45] Date of Patent: Nov. 14, 2000

[54] UTILITY DOOR WITH A SAFETY SYSTEM

[75] Inventor: Bernard Kraeutler, Dunieres, France

[73] Assignee: Nergeco S.A., Dunieres, France

[21] Appl. No.: 09/200,860

[22] Filed: Nov. 27, 1998

Related U.S. Application Data

[63] Continuation-in-part of application No. 08/930,631, filed as application No. PCT/FR96/00497, Apr. 2, 1996, abandoned.

[30] Foreign Application Priority Data

Apr. 7, 1995 [FR] France ..... 95 04202

[51] Int. Cl.[7] ..... A47G 5/02

[52] U.S. Cl. ..... 160/310; 160/291; 160/84.02

[58] Field of Search ..... 160/133, 310, 160/1, 8, 10, 84.01, 84.02, 264, 291

[56] References Cited

U.S. PATENT DOCUMENTS

| | | | |
|---|---|---|---|
| 5,307,859 | 5/1994 | Kraeutler | 160/264 |
| 5,706,875 | 1/1998 | Simon | 160/8 |

FOREIGN PATENT DOCUMENTS

| | | | |
|---|---|---|---|
| 179682 | 9/1985 | European Pat. Off. . | |
| 179682 | 4/1986 | European Pat. Off. . | |
| 9102196 | 5/1991 | Germany . | |
| 9102196 | 6/1991 | Germany . | |
| 4100608 | 7/1992 | Germany . | |
| 4166591 | 6/1992 | Japan . | |
| 41666591 | 6/1992 | Japan | 160/8 |

*Primary Examiner*—Blair M. Johnson
*Attorney, Agent, or Firm*—Sughrue, Mion, Zinn, Macpeak & Seas, PLLC

[57] ABSTRACT

A goods-handling door for opening and closing a bay in a wall, the door including a flexible curtain (1), said bay being closed off when the curtain is deployed, and open when the curtain is gathered up on an edge of the bay, the door including a rolling-up shaft on said edge of the bay for receiving said curtain, or straps serving to displace said curtain by folding it up, the rolling-up shaft being rotated by an electric motor, said curtain having an edge fixed to said shaft or in the vicinity of said shaft, and a displaceable free opposite edge, said door being characterized in that it includes a safety system including firstly at least one elongate element such as a strap that can be rolled up with the curtain or with the straps on said rolling-up shaft while one end of said strap is fixed substantially to the free edge of the curtain, and secondly signal-emitting means for emitting a signal when the tension of the strap (10) drops below a predetermined threshold.

27 Claims, 7 Drawing Sheets

UTILITY DOOR WITH A SAFETY SYSTEM

This application is a continuation-in-part of U.S. patent application Ser. No. 08/930,631 filed Mar. 4, 1998, abandoned, which is a continuation of PCT/FR96/00497, filed Apr. 2, 1996.

The present invention relates to apparatus for opening and closing a bay in a wall, in particular a goods-handling door including a flexible curtain, provided with a safety system.

The term "flexible curtain" covers any roll-up, fold-up, stack-up, or compressible curtain, and it encompasses both curtains made of flexible materials, and also curtains made up of rigid portions that are hinged together.

Various safety systems for goods-handling doors are known from the prior art.

Thus, to detect an obstacle on closing the curtain, a feeler is disposed at its bottom end, the feeler delivering a signal on making contact with said obstacle. That system suffers from the drawback of being secured to the curtain, and therefore of being displaced therewith. Installing such a feeler is thus relatively complex and costly, and it is difficult to adapt to already installed doors.

Another known safety system is designed for vertically displaceable doors in which opening is achieved by means of one of more actuating straps fixed to the bottom end of the curtain. That system uses an additional strap that is normally not tensioned and that accompanies the door while it is operating normally. If one of the actuating straps breaks, comes unhooked, or is cut, the strap that is not tensioned becomes tensioned while the curtain is operating and prevents the curtain from falling suddenly. A suitable detector may optionally deliver an alarm signal.

That system also suffers from several drawbacks. If the door encounters an obstacle on being lowered, the strap that is not tensioned remains slack and therefore does not deliver a signal. Similarly, if someone raises the bottom end of the door, e.g. for passing through to the other side, the strap that is not tensioned also remains slack and does not deliver a signal. Furthermore, if the safety strap that is not tensioned is cut or comes unhooked, no alarm is triggered. The user thinks the door is safe whereas there is in fact no longer a safety system.

Document DE-A-41 00 608 discloses apparatus for closing a bay, the apparatus including a roll-up flexible curtain. A system for protecting the motor is provided. A cord attached to the free end of the curtain is guided by pulleys to a rolling-up drum on the same axis as the rolling-up drum for rolling up the curtain. The cord is paid out while the curtain is being rolled up. An instrument responds to the tension of the cord. If the curtain is blocked in the closed position, e.g. by being iced up, the curtain cannot open, whereas the cord is paid out: the tension of the cord decreases and the instrument responsive to the tension of the cord interrupts the power supply to the motor. The motor is thus not damaged. But that protection-system does not act during closing, nor does it act when the curtain is in the closed position if said curtain is raised in an attempt to break in.

An object of the invention is to provide a safety system that does not suffer from the above-mentioned drawbacks. In particular, an object of the present invention is to provide a door provided with a safety system that offers protection against malfunction of one or more actuating straps, that offers protection against the presence of obstacles while the door is being closed, and that offers protection against break-in.

An object of the invention is also to provide-such a multi-purpose safety system that is very cheap and easy to install, even on already existing doors.

The present invention thus provides a goods-handling door for opening and closing a bay in a wall, the door including a flexible curtain, said bay being closed off when the curtain is deployed, and open when the curtain is gathered up on an edge of the bay, the door including a rolling-up shaft on said edge of the bay for receiving said curtain, or straps serving to displace said curtain by folding it up, the rolling-up shaft being rotated by an electric motor, said curtain having an edge fixed to said shaft or in the vicinity of said shaft, and a displaceable free opposite edge, said door being characterized in that it includes a safety system including firstly at least one elongate element such as a strap that can be rolled up with the curtain or with the straps on said rolling-up shaft while one end of said strap is fixed substantially to the free edge of the curtain, and secondly signal-emitting means for emitting a signal when the tension of the strap drops below a predetermined threshold.

The safety system of the invention thus offers the following advantages: firstly, if, while the curtain of the door is being closed, said curtain encounters an obstacle, the strap slackens and the safety system is actuated. This is also the case if the strap breaks because the strap breaking automatically leads to a decrease in the tension of said strap. Furthermore, when the curtain is in the closed position, the strap is normally tensioned so that if someone wishes to pass through by raising the bottom end of the curtain of the door, said strap slackens, and the safety system is actuated. The safety system of the present invention thus acts as an obstacle detector, as an actuating strap break detector, and as a break-in detector. Moreover, the safety system of the invention is stationary and does not move with the curtain. It is thus cheap and it can be installed very easily during or after installation of the door.

Advantageously, the safety system includes monitoring means for monitoring a tension of the strap.

Preferably, the monitoring means for monitoring the tension of a strap comprise a moving member co-operating at one end with said strap and connected at the other end to said signal-emitting means, said moving member being displaceable between a rest position in which it does not actuate said signal-emitting means and a warning position in which it does actuate said signal-emitting means, said moving member being biased towards its warning position by bias means, and being maintained in its rest position by the strap as tensioned, so that when the tension of the strap drops below a predetermined threshold, said moving member is brought into its warning position by said bias means.

Advantageously, said signal-emitting means are of the electrical and/or electronic type, said moving member acting as a switch and making the contact necessary to actuate said signal-emitting means only when it is in its warning position.

In a variant, a signal emitted by said signal-emitting means causes the displacement of the curtain to stop.

In another variant, a signal emitted by said signal-emitting means causes the curtain to open.

These two variants are particularly applicable when the safety system acts as an obstacle detector or as a strap break detector.

Furthermore, a signal emitted by said signal-emitting means may cause an alarm system to be actuated, in particular when the curtain is closed and the shaft is stationary. The alarm system may be either a sound alarm system, a light alarm system, or any other known alarm system.

In a first variant, the safety system of the invention is applicable to bay-closing apparatus in which the curtain is of the vertical displacement type and is gathered up at the top of said bay. Preferably, the curtain includes at least one rigid and/or heavy element disposed horizontally at the bottom of the curtain when said curtain is deployed, said strap being vertical and being fixed to said rigid and/or heavy bottom element. It can be understood that the closer the strap is fixed to the bottom edge of the curtain, the more effective it is.

In another variant, the safety system is applicable to a bay-closing system in which the curtain is of the horizontal displacement type, and includes at least one rigid and/or heavy element disposed vertically, said at least one strap being horizontal and being fixed to said rigid and/or heavy element.

In which case, said curtain is advantageously implemented in two portions, each of which is gathered up on a respective side edge of the bay, each curtain portion including at least one rigid and/or heavy element extending vertically and disposed at its vertical edge that faces the other curtain portion when said curtain is deployed, and each curtain portion including at least one horizontal strap fixed to said respective rigid and/or heavy element.

In a first embodiment of the invention, the curtain is gathered up by rolling up the curtain, said strap being rolled up with the curtain so as to remain tensioned while the curtain is operating normally.

In a second embodiment of the invention, the curtain is gathered up being folded up or stacked up, said strap the advantageously being a strap for actuating the curtain by acting on said rigid and/or heavy element to displace said curtain towards its gathered-up position.

Advantageously, said rigid and/or heavy element is a bar, but it may also be formed by a rigid panel or by a deformable draught excluder.

Other characteristics and advantages of the present invention appear on reading the following detailed description given by way of non-limiting example and with reference to the accompanying drawings, in which.

DETAILED DESCRIPTION OF THE PREFERRED EMBODIMENTS

Figure 3:
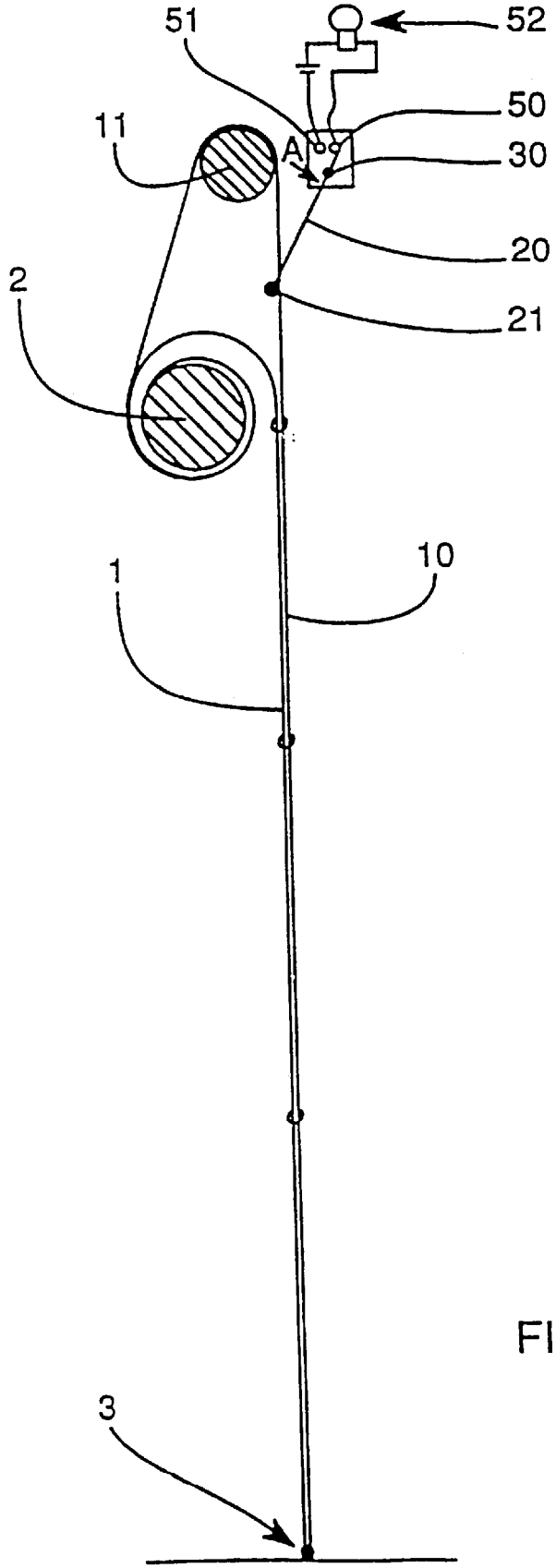
FIG. 3 is a diagrammatic view of the safety system of the invention as used on a roll-up door, the safety system being in its rest position.
Figure 4:
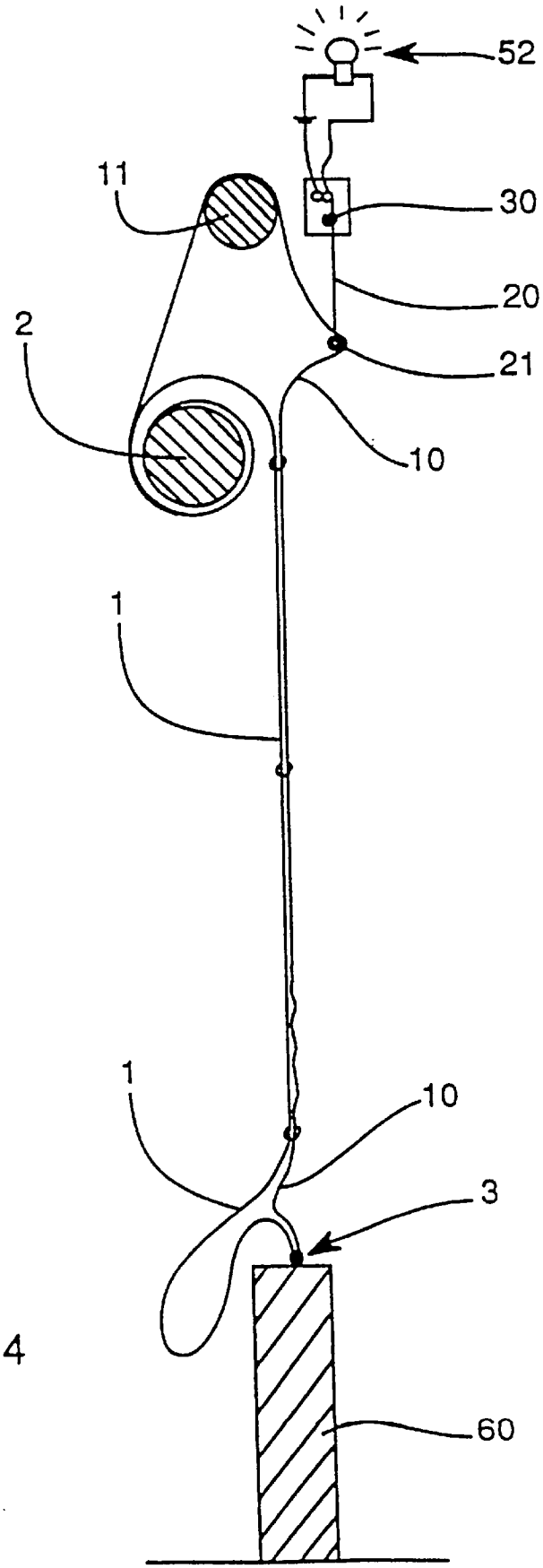
FIG. 4 is a view similar to the FIG. 3 view but showing the safety system in its warning position.
Figure 5:
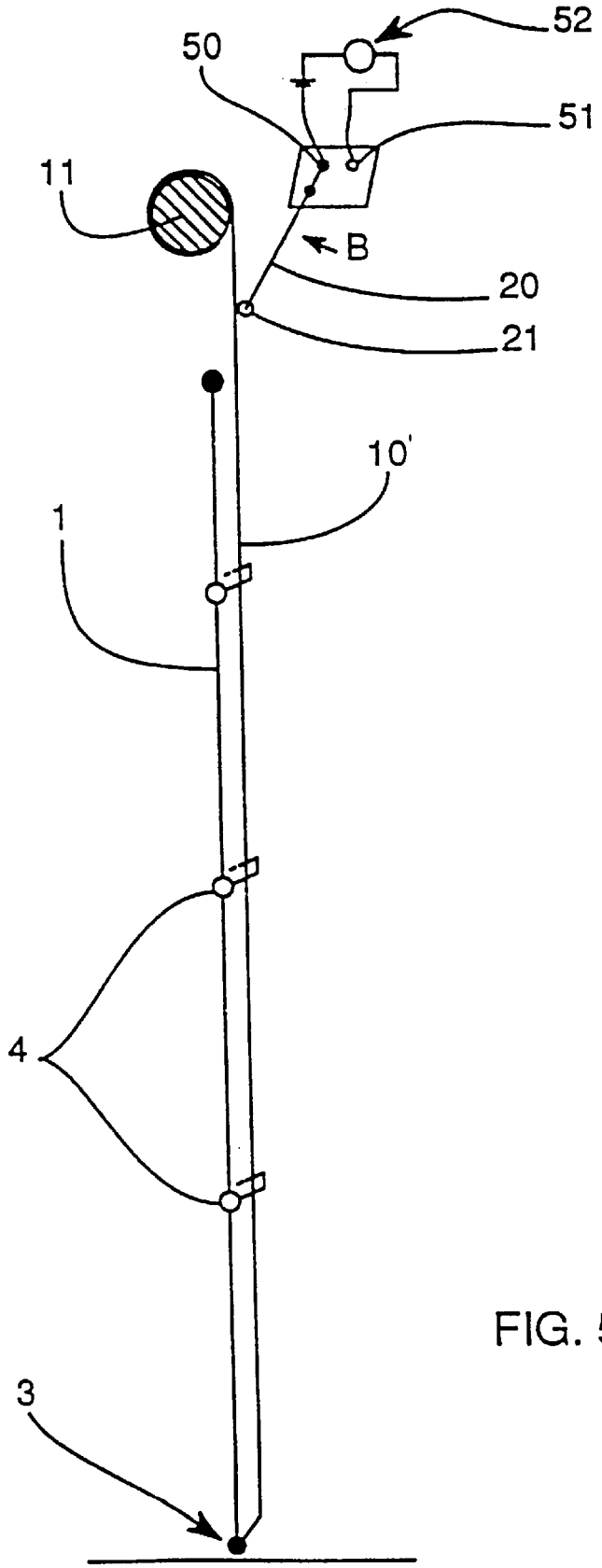
FIG. 5 is a diagrammatic view of a variant of the safety system of the invention as used on a stack-up door, the safety system being in its rest position.
Figure 6:
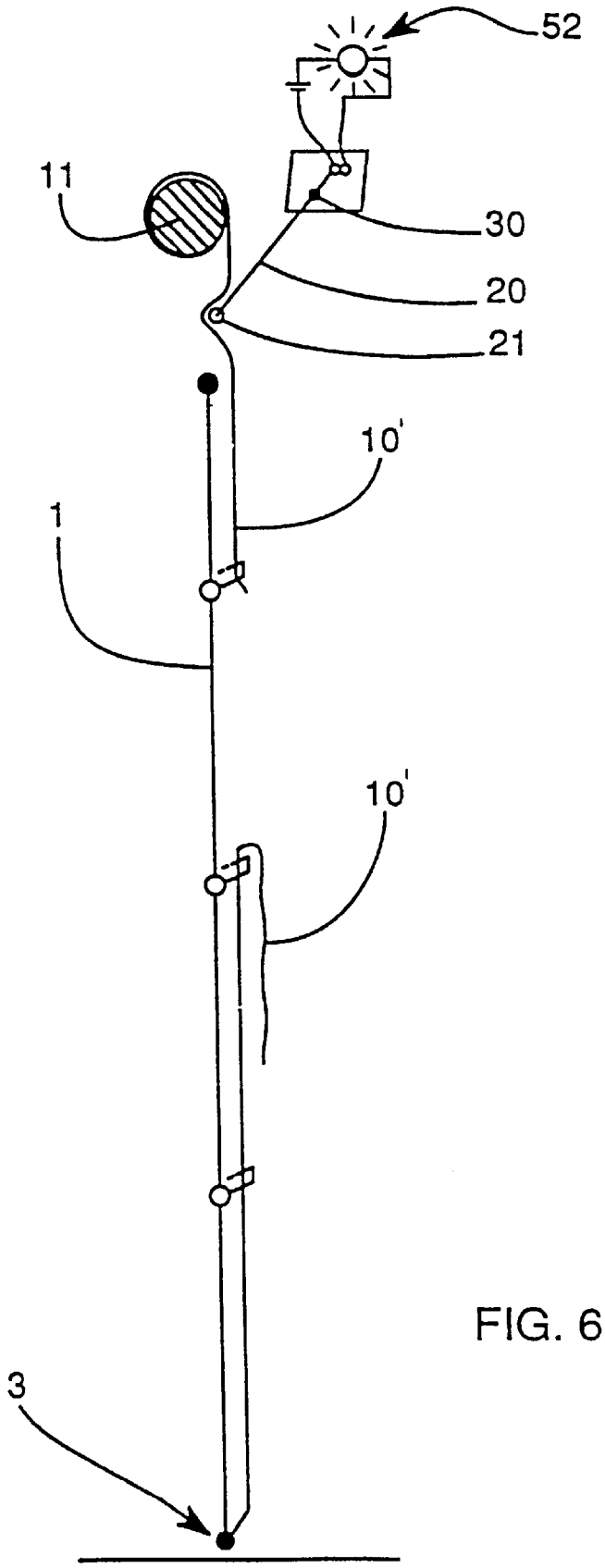
FIG. 6 is a view similar to the FIG. 5 view but showing the safety system in its warning position.
Figure 7:
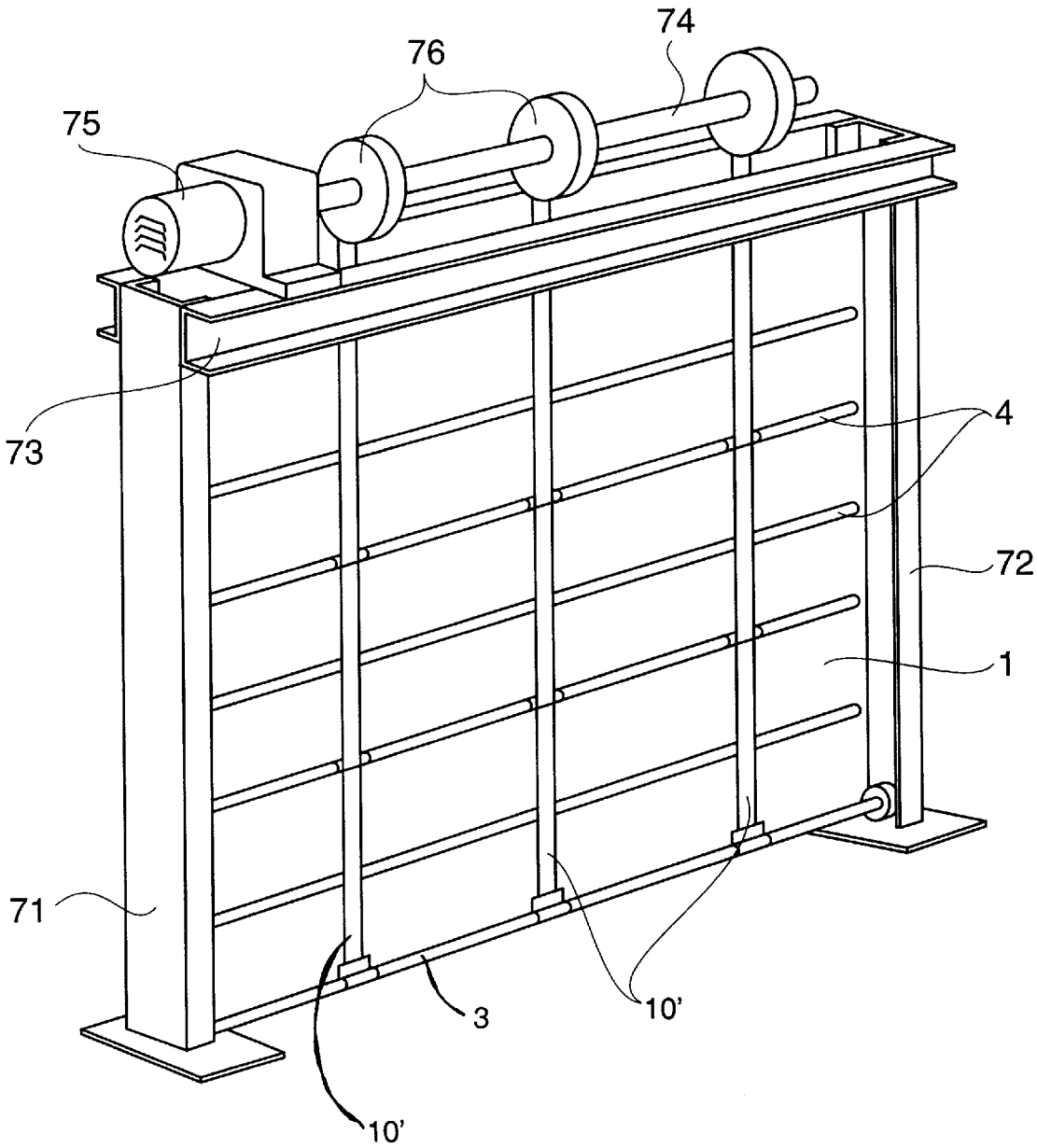
FIG. 7 is a perspective view of a type of a goods-handling door for which the invention may be used.

A goods-handling door is to be placed in front of an opening in a wall, and comprises a flexible curtain which may be gathered on top of the door, either by rolling-up the curtain on a shaft, as represented in FIGS. 3 and 4 of the present specification, or by folding the curtain which is displaced upwards by means of lifting straps 10', as shown in FIGS. 5, 6 and 7. The door comprises two uprights 71, 72 interconnected at their top ends by a cross member 73, bearing a rotatable shaft 74 driven by an electric motor 75, the shaft being fitted with reels 76.

The door includes a curtain 1, reinforced with horizontal bars 4 including a lower bar 3. Several lifting straps 10' are fixed at their upper ends to reels 76 and at their other ends to the lower bar 3. The straps are vertically disposed against the curtain and pass through stirrups fixed to at least some bars, so that when the shaft is driven by the motor, the lifting straps 10' are rolled-up on the reels, the lower bar 3 is drawn upwards, and the curtain is folded at the top of the door in accordion or concertina style.

According to the present invention, a safety system includes a safety strap 10 which is placed against the curtain or against a lifting strap 10' of the curtain. One end of the safety strap ' is fixed to the lower bar 3 and the other end is rolled up either with the curtain or with a lifting strap.

Figure 1:
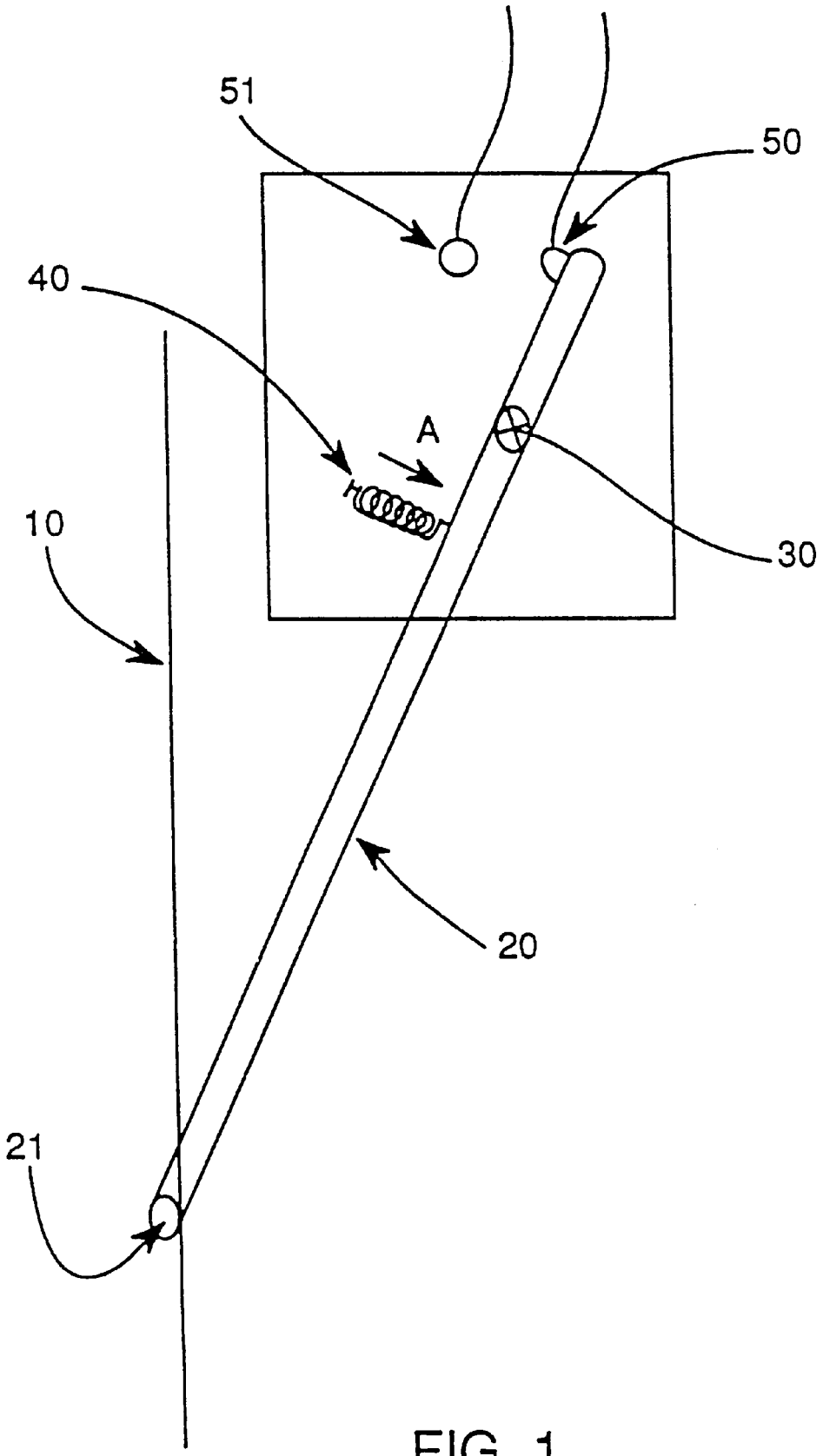
FIG. 1 is a diagrammatic view of the safety system of the invention in the rest position.
Figure 2:
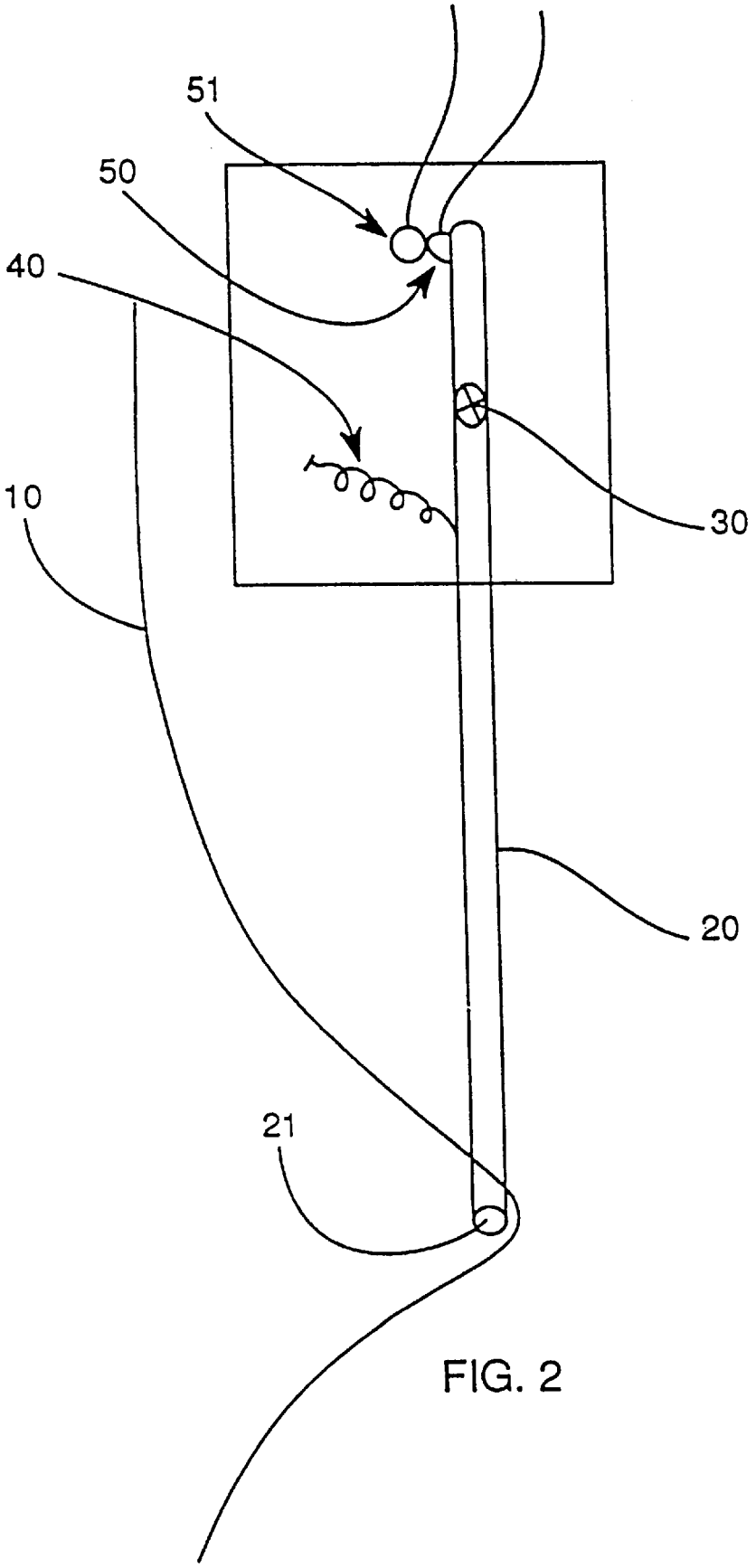
FIG. 2 is a diagrammatic view of the FIG. 1 safety system of the invention in the warning position.

With reference to FIGS. 1 and 2, the safety system of the door of the invention includes means for monitoring the tension of a safety strap 10 which is secured to a curtain of apparatus for opening and closing a bay in a wall. The means for monitoring the tension of the safety strap advantageously include a moving member 20 which can be displaced between a rest position in which the safety system is not actuated, and a warning position in which the safety system is actuated. The moving element cooperates at one end with said safety strap 10. Preferably, at its end that cooperates with said safety strap 10, the moving element is provided with a follower member 21 that slides, slips or rotates about its own axis on said safety strap 10 while it is being displaced during opening or closing of the curtain. As shown in FIGS. 1 and 2, the moving member is advantageously made in the form of a rod 20 that pivots about an axis 30 between its rest position and its warning position, and the follower member 21 is disposed against said safety strap 10 such that when said safety strap 10 is tensioned, said rod 20 is held in its rest position. The invention further provides bias means comprising a resilient member such as a spring 40 which is fixed via one of its ends to said rod. The spring 40 is organized such that when the rod 20 is in the rest position, it exerts a force on said rod which acts in the direction indicated by arrow A in FIG. 1. Said spring 40 could equally well be disposed on the other side of said rod 20, it then acting as a return spring. Similarly, it is quite possible to consider providing any other bias means exerting a force in the direction indicated by arrow A on the rod 20 when said rod is in its rest position. The safety system of the invention further includes signal-emitting means 50, 51 which are actuated by said monitoring means described above. Thus, an electrical terminal 50 is advantageously disposed at that end of the rod 20 which is distant from the safety strap 10, and another electrical terminal 51 is advantageously disposed so that it is fixed relative to the axis of rotation 30 of the rod 20. When said rod 20 is in its rest position, the two electrical terminals 50, 51 are spaced apart and the safety system is thus not activated. When, as shown diagrammatically in FIG. 2, the safety strap 10 slackens for any reason, the rod 20 pivots about its axis 30 under the effected of the spring 40 so that said electrical terminal 50 secured to said rod 20 comes into contact with the other electrical terminal 51 disposed in fixed manner relative to said axis 30. The rod 20 thus acts as a sort of switch which, when the rod 20 is in the warning position, closes an electrical circuit organized to emit one or more signals. The signals are then used to activate various safety mechanisms which are described in detail below.

FIGS. 3 and 4 show a first use of the safety system of the invention on apparatus, such as a goods-handling door, for closing a bay in a wall. The goods-handling door includes a flexible curtain 1 mounted to be displaced vertically, and gathered up in the top portion by being rolled up around a cylinder 2 provided for this purpose. A safety strap 10 is fixed to said curtain 1 approximately at its top end and at its bottom end. In the example shown in FIG. 3, the bottom end of the curtain 1 is provided with a rigid and/or heavy element which may advantageously be a reinforcing bar 3 extending horizontally over the entire width of the curtain 1. Naturally, the curtain 1 may include other additional reinforcing bars (not shown). The safety strap 10 is preferably fixed to said bottom bar 3 and it extends vertically along said curtain 1 so as to be rolled up with it around said cylinder 2. Preferably, in the top portion of the apparatus, the safety strap 10 extends beyond the cylinder 2 on which the curtain 1 is rolled up, so as to effect an additional-loop about a roller 11, thereby making a space in which to install the safety system of the invention, described above with reference to FIGS. 1 and 2. Since the safety strap 10 is secured to the curtain 1 at the top end thereof, it is rolled up, and unrolled together therewith, so that, while the curtain is operating normally, the safety strap 10 is always tensioned even though it exerts no traction force for rolling up or unrolling the curtain 1. A safety system of the invention as described above is then disposed about the safety strap 10 in the top portion of the apparatus. Thus, while the curtain is operating normally, the safety strap 10 remains tensioned, and the rod 20 slides via its follower member 21 on said safety strap while said safety strap is being rolled up or unrolled. The safety strap 10 as tensioned maintains said rod 20 in its rest position as explained above. If, as shown in FIG. 4, the curtain 1 encounters an obstacle 60 while it is being lowered, the curtain 1, and as a result the safety strap 10, become slack so that, under the effect of the spring 40, the rod 20 pivots about its axis 30, and establishes contact between the two electrical terminals 50 and 51. The two electrical terminals 50 and 51 coming into contact with each other is shown diagrammatically by a bulb 52 lighting up to show that a signal has been emitted. The signal emitted on contact being made between the electrical terminal 50 secured to the rod 20 and the electrical terminal 51 disposed in fixed manner may naturally be used in various different ways. Thus, the signal may cause the curtain to stop or even to be raised again by sending a corresponding signal to the displacement means (not shown) for displacing said curtain 1. It may also activate an alarm signal which may be a sound signal or a light signal, or any other known alarm system. If the obstacle 60 is removed from the path of the curtain 1, said curtain can operate normally again, and the strap tightens again, thereby bringing the rod 20 of the safety system back into its rest position. Naturally, the same result is obtained, i.e. the safety system is activated, if someone tries to lift the bottom end of the curtain 1 when said curtain is in the lowered position. The safety system thus acts both as a break-in detector and as an obstacle detector.

In the example shown in FIGS. 3 and 4, the bottom end of the curtain 1 is provided with a rigid bar 3. Naturally, the safety strap 10 may also be fixed directly to the bottom of said curtain 1, and the invention is thus also applicable to a roll-up curtain that has no rigid and/or heavy element at its bottom.

FIGS. 5 and 6 show the use of the safety system of the invention on another type of goods-handling door, namely a stack-up goods-handling door. In this type of door, the curtain 1 is said to be flexible either because of its material, or because it is made up of rigid panels that are hinged together about hinge bars 4. In this case, the curtain 1 is not rolled up about a roller as described above, but rather it is stacked up in known manner at the top of the apparatus. Said curtain is opened and closed by means of one or more actuating straps 10' which are therefore tensioned while the curtain is being displaced, and which are rolled up at the top end about a roller 11 for raising and lowering the curtain 1. Said actuating straps 10' are preferably fixed to a rigid and/or heavy element disposed at the bottom end of the curtain 1. This element may, for example, be a reinforcing bar 3 when the curtain is made of a flexible material, as shown diagrammatically in FIG. 3. Naturally, the rigid element disposed at the bottom end of the curtain 1 may also be a rigid panel hinged about said hinge bars 4. A variant embodiment of the safety system of the invention is shown in FIGS. 5 and 6. Thus, as shown in FIG. 5, the pivotally mounted rod 20 and its follower member 21 are disposed on the same side of the actuating strap 10', and the bias means 40, e.g. a spring, exerts a force in the direction indicated by arrow B when the rod 20 is in the rest position. If the actuating strap 10' slackens, e.g. because it breaks, as shown in FIG. 6, the safety system operates as described above, i.e. under the effect of the force created by the spring in the direction indicated by arrow B, the rod 20 pivots about the axis 30, and causes the two electrical terminals 50 and 51 to come into contact with each other so that a signal is emitted, as shown diagrammatically by the lit-up bulb 52 in FIG. 6. As compared with the embodiment described in FIGS. 1 to 4, the rod of the safety system thus pivots in the other direction about the axis 30, and the actuating strap 10' as slackened is pushed away by the follower member of the rod 20, instead of being entrained thereby as described above.

Since the straps on stack-up goods-handling doors are actuating straps, i.e. they exert a considerable force for raising the curtain 1, the safety system of the invention protects against one of the actuating straps 10 breaking. If such a safety system is disposed on every actuating strap 10' of the curtain, any one of them breaking triggers the safety system so that the displacement of the curtain can be stopped. If one or more straps comes unhooked, or are cut while the curtain is in the lowered position, the safety system is also actuated, and a sound and/or light alarm may be activated.

Although the safety system of the invention is described with reference to vertically displaceable doors, the safety system of the invention can also be adapted to suit horizontally displaceable goods-handling doors. The safety system operates identically except that, the straps are is placed horizontally. For example, for a curtain formed of two curtain portions, each of which is gathered up on a side edge of the bay, at least one horizontal strap is advantageously provided fixed to each curtain portion, preferably at those vertical edges of the curtain portions which face each other when the curtain is closed. The same obstacle and break-in detection results as described above are thus obtained.

What is claimed is:

1. A goods-handling door for opening and closing a bay in a wall, the door including a flexible curtain, said bay being closed off when the curtain is deployed, and open when the curtain is gathered up on an edge of the bay, the door including a rolling-up shaft on said edge of the bay for receiving said curtain, the rolling-up shaft being rotated by an electric motor, said curtain having an edge fixed to said shaft and having a displaceable free opposite edge, said door being characterized in that it includes a safety system including:

a safety strap disposed along the curtain perpendicular to the rolling-up shaft, one end of said safety strap being fixed to the rolling-up shaft, and said safety strap being capable of being rolled up with the curtain on said rolling-up shaft between the rolled-up turns of the curtain, the other end of said safety strap being fixed to the curtain adjacent the free edge of the curtain; and a signal-emitting means for emitting a signal when the tension of the safety strap drops below a predetermined threshold.

2. A door according to claim 1, in which the safety system includes monitoring means for monitoring the tension of the safety strap.

3. A door according to claim 2, in which the monitoring means for monitoring the tension of the safety strap comprise a moving member co-operating at one end with said safety strap and connected at the other end to said signal-emitting means, said moving member being displaceable between a rest position in which it does not actuate said signal-emitting means and a warning position in which it does actuate said signal-emitting means, said moving member being biased towards its warning position by bias means, and being maintained in its rest position by the safety strap as tensioned, so that when the tension of the safety strap drops below a predetermined threshold, said moving member is brought into its warning position by said bias means.

4. A door according to claim 3, in which said moving member is a rigid rod (20) connected at one end to said safety strap in slidable manner, and maintained in its rest position by said safety strap as tensioned, the bias means comprising a resilient spring which is loaded when the rod is in the rest position, and which, when the tension of the safety strap decreases, urges said rod towards its warning position, said warning position being reached when the tension of said safety strap reaches said predetermined threshold.

5. A door according to claim 1, in which a signal emitted by said signal-emitting means causes the displacement of the curtain to stop.

6. A door according to claim 1, in which a signal emitted by said signal-emitting means causes the curtain to open.

7. A door according to claim 1, in which a signal emitted by said signal-emitting means causes an alarm system to be actuated.

8. A door according to claim 1, in which the curtain is of the vertical displacement type and is gathered up at the top of said bay.

9. A door according to claim 8, in which the curtain includes at least one rigid element disposed horizontally on the free edge of the curtain when said curtain is deployed, said safety strap being vertical and being fixed to said rigid element.

10. A door according to claim 8, in which the curtain is gathered up by rolling up the curtain, said safety strap being rolled up with the curtain so as to remain tensioned while the curtain is operating normally.

11. A door according to claim 9, in which said rigid element is a bar.

12. A door according to claim 8, in which the curtain includes at least one heavy element disposed horizontally on the free edge of the curtain when said curtain is deployed, said safety strap being vertical and being fixed to said heavy element.

13. A door according to claim 12, in which said heavy element is a bar.

14. A goods-handling door for opening and closing a bay in a wall, the door including a flexible curtain and at least one actuating strap, said bay being closed off when the curtain is deployed, and open when the curtain is gathered up on an edge of the bay, the door including a rolling-up shaft on said edge of the bay for receiving said at least one actuating strap and, thereby, displacing said curtain by folding it up, the rolling-up shaft being rotated by an electric motor, said curtain having an edge fixed adjacent to said shaft and having a displaceable free opposite edge, said door being characterized in that it includes a safety system including:

a signal-emitting means for emitting a signal when the tension of the actuating strap drops below a predetermined threshold.

15. A door according to claim 14, in which the safety system includes monitoring means for monitoring the tension of the actuating strap.

16. A door according to claim 15, in which the monitoring means for monitoring the tension of the actuating strap comprise a moving member co-operating at one end with the actuating strap and connected at the other end to said signal-emitting means, said moving member being displaceable between a rest position in which it does not actuate said signal-emitting means and a warning position in which it does actuate said signal-emitting means, said moving member being biased towards its warning position by bias means, and being maintained in its rest position by the actuating strap as tensioned, so that when the tension of the actuating strap drops below a predetermined threshold, said moving member is brought into its warning position by said bias means.

17. A door according to claim 16, in which said moving member is a rigid rod connected at one end to said actuating strap in a slidable manner, and maintained in its rest position by said actuating strap as tensioned, the bias means comprising a resilient spring which is loaded when the rod is in the rest position, and which, when the tension of the actuating strap decreases, urges said rod towards its warning position, said warning position being reached when the tension of said actuating strap reaches said predetermined threshold.

18. A door according to claim 14, in which a signal emitted by said signal-emitting means causes the displacement of the curtain to stop.

19. A door according to claim 14 in which a signal emitted by said signal-emitting means causes the curtain to open.

20. A door according to claim 14, in which a signal emitted by said signal-emitting means causes an alarm system to be actuated.

21. A door according to claim 14, in which the curtain is of the vertical displacement type and is gathered up at the top of said bay.

22. A door according to claim 21, in which the curtain includes at least one rigid element disposed horizontally on the free edge of the curtain when said curtain is deployed, said actuating strap being vertical and being fixed to said rigid element.

23. A door according to claim 22, in which said rigid element is a bar.

24. A door according to claim 21, in which the curtain includes at least one heavy element disposed horizontally on the free edge of the curtain when said curtain is deployed, said actuating strap being vertical and being fixed to said heavy element.

25. A door according to claim 24, in which the curtain is gathered up, said actuating strap being a strap for actuating the curtain by acting on said heavy element to displace said curtain towards its gathered-up position.

26. A door according to claim 24, in which said heavy element is a bar.

27. A door according to claim 22, in which the curtain is gathered up, said actuating strap being a strap for actuating the curtain by acting on said rigid element to displace said curtain towards its gathered-up position.

* * * * *